US007314201B2

(12) United States Patent
Marshall et al.

(10) Patent No.: US 7,314,201 B2
(45) Date of Patent: Jan. 1, 2008

(54) DAMPENED RETRACTABLE FURNITURE CUP HOLDER

(75) Inventors: Richard E Marshall, Monroe, MI (US); Michael E Mohn, Monroe, MI (US); Larry P LaPointe, Temperance, MI (US); Christopher J Knabusch, Monroe, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 391 days.

(21) Appl. No.: 11/031,725

(22) Filed: Jan. 7, 2005

(65) Prior Publication Data

US 2006/0170257 A1 Aug. 3, 2006

(51) Int. Cl.
*A47K 1/08* (2006.01)
*A47C 7/62* (2006.01)

(52) U.S. Cl. ..... 248/311.2; 297/188.14

(58) Field of Classification Search ..... 248/311.2; 297/188.14, 188.18, 188.19
See application file for complete search history.

(56) References Cited

U.S. PATENT DOCUMENTS 3,675,969 A * 7/1972 Gage ..... 297/188.18
4,719,764 A * 1/1988 Cook ..... 62/261
4,863,134 A 9/1989 Young et al.
4,974,741 A * 12/1990 Gustafson et al. ..... 220/739
5,007,610 A * 4/1991 Christiansen et al. .... 248/311.2
5,141,194 A * 8/1992 Burgess et al. ..... 248/311.2
5,174,534 A * 12/1992 Mitchell ..... 248/311.2
5,220,706 A 6/1993 Bivens
5,284,314 A 2/1994 Misaras et al.
5,285,953 A * 2/1994 Smith ..... 220/737
5,518,223 A 5/1996 Bivens
5,634,621 A * 6/1997 Jankovic ..... 248/311.2
5,647,578 A 7/1997 Bivens
5,657,969 A 8/1997 Bivens
5,673,891 A 10/1997 Fujihara et al.
5,897,041 A * 4/1999 Ney et al. ..... 224/483
5,897,089 A * 4/1999 Lancaster et al. ..... 248/311.2
5,899,426 A * 5/1999 Gross et al. ..... 248/311.2
5,988,579 A * 11/1999 Moner et al. ..... 248/311.2
6,019,334 A 2/2000 Shinomiya
6,085,384 A 7/2000 Bivens
6,176,475 B1 1/2001 Bella et al.
6,189,662 B1 2/2001 Bivens et al.
6,213,454 B1 4/2001 Bivens et al.
6,269,919 B1 8/2001 Bivens et al.
6,460,666 B1 10/2002 Wach
6,513,811 B1 2/2003 Bivens (Continued)

*Primary Examiner*—Anita M. King
(74) *Attorney, Agent, or Firm*—Harness, Dickey & Pierce, P.L.C.

(57) ABSTRACT

A furniture mounted cup holder includes a cup holder base having a perimeter wall defining an interior cavity. A lid is slidably received within the cavity. The lid includes: a flat end surface to support a beverage container; an outer perimeter wall which slides against the cup holder base perimeter wall; and at least one indentation created at a junction between the outer perimeter wall and the end surface. The indentation assists in manual removal of the lid from the cup holder base. A biasing device is in contact with both the end surface of the lid and the cup holder base. The biasing device displaces the lid between a latched, lid depressed position and a lid extended position. Radial extensions of the lid help center the lid in the cavity and prevent lid rotation.

41 Claims, 6 Drawing Sheets

U.S. PATENT DOCUMENTS 6,637,709 B1 10/2003 Guenther et al.
6,702,241 B2 3/2004 Harada
6,712,325 B2 * 3/2004 Choi ..... 248/311.2
6,726,219 B2 4/2004 Bivens
6,732,894 B2 5/2004 Hubbert et al.
6,799,705 B1 10/2004 Lutoslawski
6,834,838 B2 * 12/2004 Dennis et al. ..... 248/311.2
7,036,700 B2 * 5/2006 Engel et al. ..... 224/501
2001/0030217 A1 10/2001 Corrion et al.
2002/0153399 A1 10/2002 Hubbert et al.
2002/0167133 A1 11/2002 Bivens
2002/0180102 A1 12/2002 Corrion et al.
2003/0019991 A1 1/2003 Carlson et al.
2003/0140451 A1 7/2003 Bivens et al.

* cited by examiner

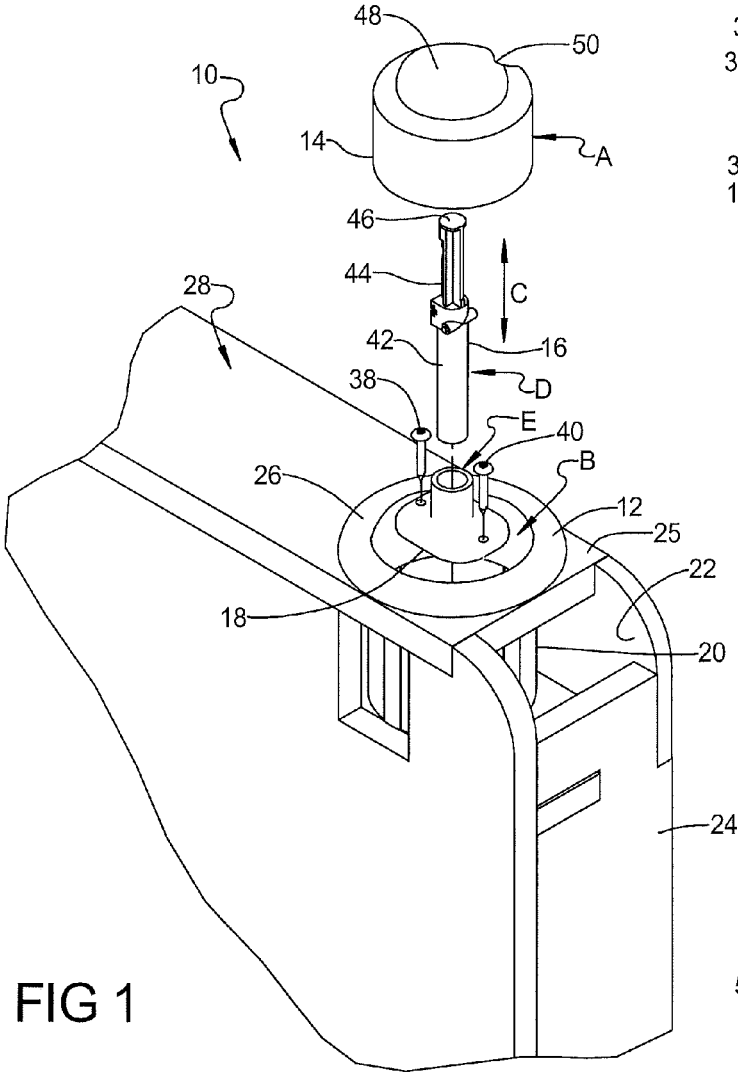
FIG 1
FIG 2
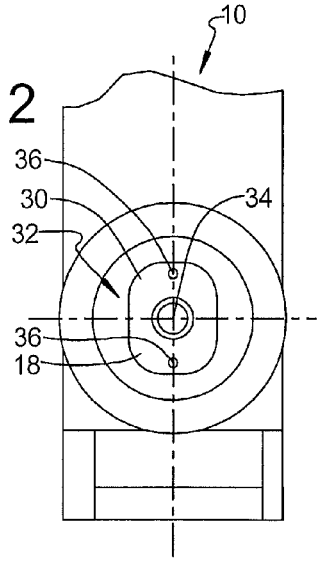
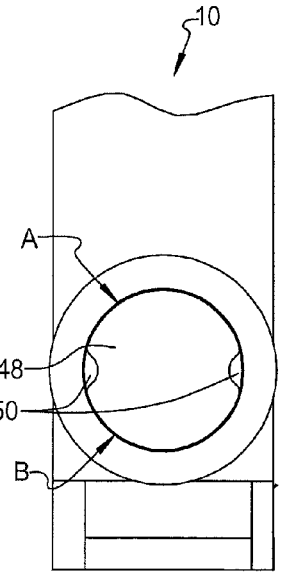
FIG 3

FIG 7
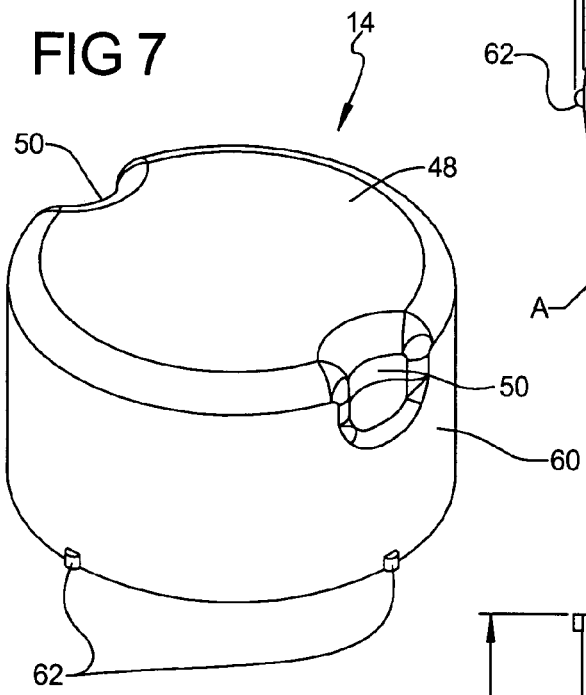
FIG 8
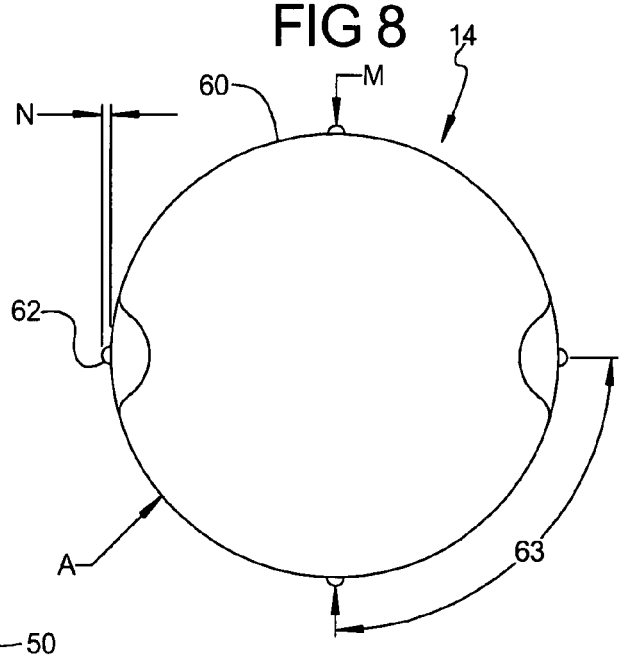
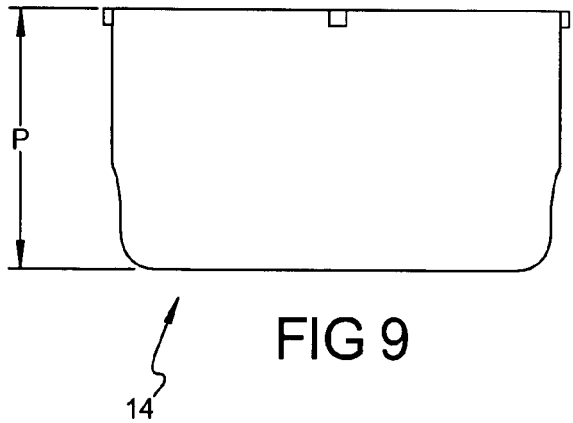
FIG 9

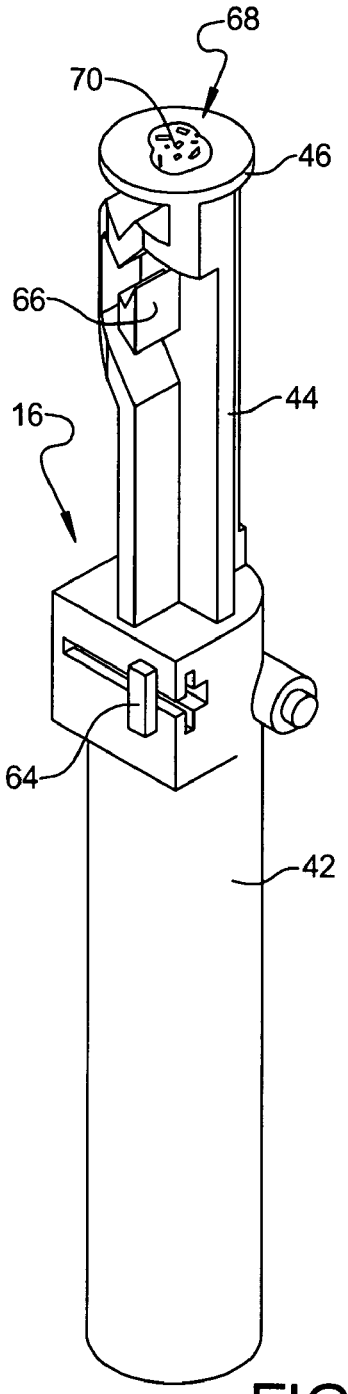
FIG 10
FIG 11
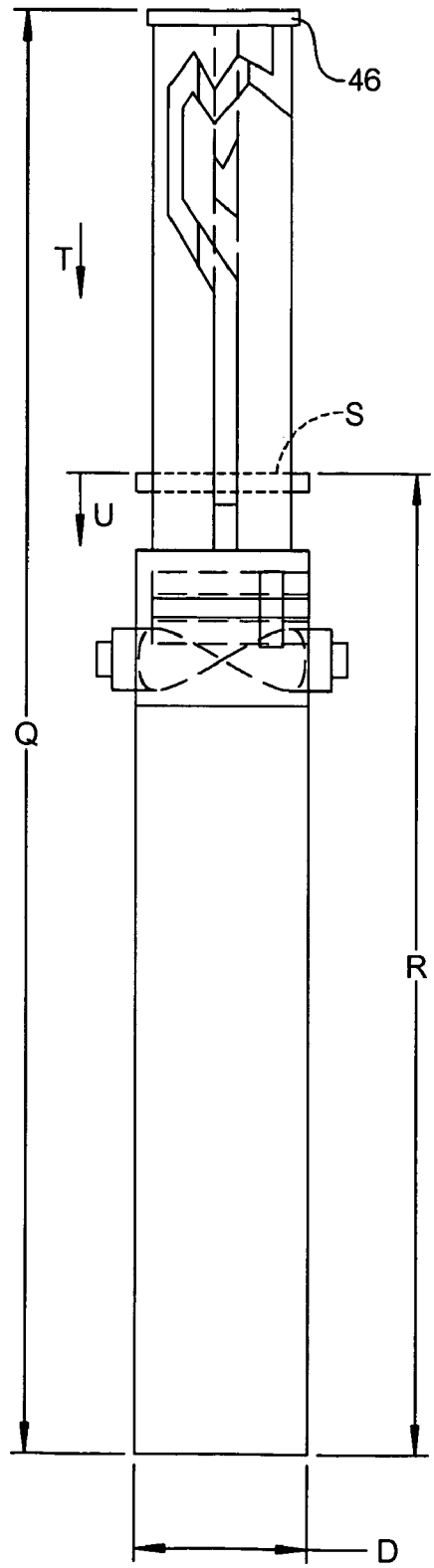

FIG 12
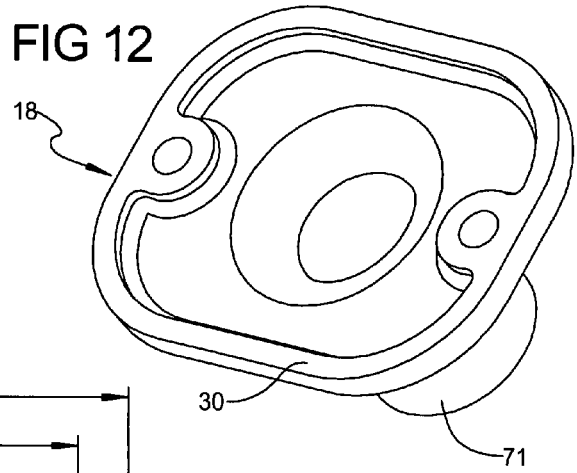
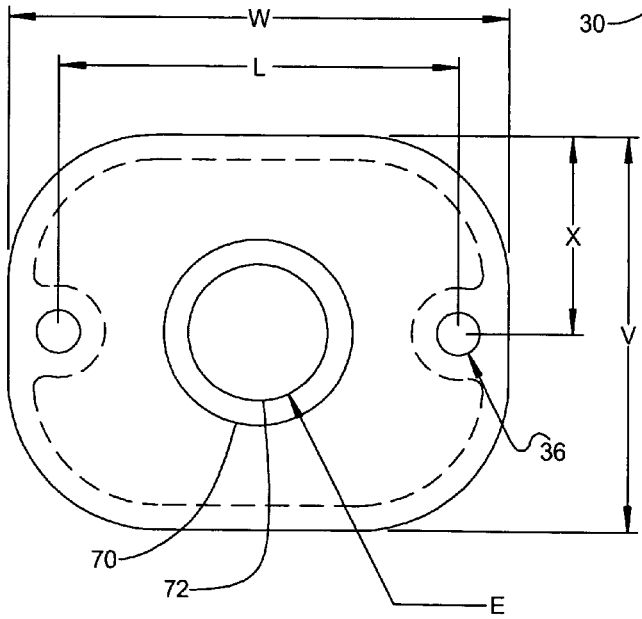
FIG 13
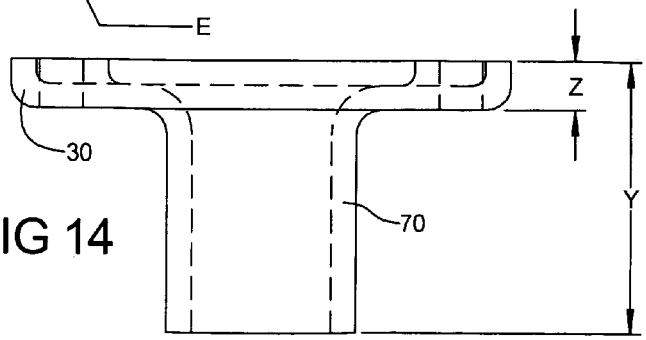
FIG 14

DAMPENED RETRACTABLE FURNITURE CUP HOLDER

FIELD OF THE INVENTION

The present invention relates in general to beverage cup holders and more specifically to an apparatus and method for mounting a retractable furniture mounted cup holder.

BACKGROUND OF THE INVENTION

Cup holder devices are known, particularly for use in automotive applications as well as in a variety of furniture applications. These cup holder designs function by providing a support surface and frequently one or more beverage holder surrounding support elements which prevent tipping or spilling of the beverage holder contents during use. Fixed design cup holders exist for furniture applications such as used in movie theater seating configurations and in outdoor furniture. These cup holder designs typically have a support surface for the bottom of the beverage container as well as beverage container side support members or a partial enclosure to retain the beverage container.

Beverage or cup holder designs for use in furniture applications such as reclining chairs and/or sofas are also known which displace from a non-loaded or fully extended position to a container holding or fully depressed position. A biasing device such as a damper is used to control the travel speed and total displacement of a lid or cup holder portion as the beverage container is displaced into and received by the cup holder design. The dampening device can include a latching mechanism which latches the lid or beverage holder support portion in a fully depressed position. Release of the dampening device from the latched position thereafter returns the lid with or without the beverage container to the cup holder fully extended position.

Several disadvantages exist with the current designs of furniture mounted beverage cup holders. The lid or portion of the cup holder which directly supports the beverage container is typically non-removable, therefore if beverage or container held material spills from the container into the cup holder it is difficult or impossible to completely clean the interior of the cup holder. To ensure the damper maintains contact with the lid assembly, the damper or a portion of the damper is commonly affixed to the lid using an adhesive or other mechanical attachment method. This prevents disassembly of the cup holder design in the event that the damper requires replacement. The damper itself is also commonly fixed to the cup holder portion which also makes alignment of the damper more difficult as well as complicating or preventing removal of the damper for replacement, cleaning or repair.

There is therefore a need for a cup holder design which permits a beverage container to be displaced within the cup holder design but which also provides for cleaning and/or maintenance of the cup holder and/or the cup holder displacement mechanism.

SUMMARY OF THE INVENTION

According to a preferred embodiment of the present invention, a dampened retractable furniture cup holder of the present invention includes a cup holder base retained by a furniture member. A lid is slideably received within the cup holder base. The lid includes a plurality of finger grip indentations operable to manually grasp the lid for removal from the cup holder base.

According to another embodiment of the present invention, a furniture mounted cup holder device includes a cup holder base having a perimeter wall defining an interior cavity. A lid is slidably received within the cavity. The lid includes: a substantially flat end surface adapted to support a beverage container; an outer perimeter wall slidingly positionable adjacent the cup holder base perimeter wall; and at least two indentations created at a junction between the outer perimeter wall and the end surface. A biasing device having a first end continuously contacts the end surface of the lid, the biasing device being operable to displace the lid between a lid depressed position and a lid extended position.

According to still another preferred embodiment of the present invention, a furniture mounted cup holder includes a cup holder base retainable by a furniture member. The cup holder base includes at least one raised surface member extending radially outward and operable to resist rotation of the cup holder base when retained by the furniture member. A lid is slideably received within the cup holder base. The lid includes an outer perimeter wall. A plurality of extensions extend radially outward from the outer perimeter wall. Each raised surface member operably creates a channel at the inner perimeter wall of the cup holder base which slidably receives one of the extensions and prevents rotation of the lid with respect to the cup holder base.

According to yet still another preferred embodiment of the present invention, a cup holder system includes a furniture member. A cup holder base including an open ended cavity is releasably mounted to the furniture member. A lid is slidably positioned within the cup holder base. A plurality of finger grip indentations are formed in the lid and permit manual removal of the lid from the cup holder base. A dampening device is mounted to the cup holder base and contacts the lid. The dampening device operates to displace the lid at least between a depressed position and a fully extended position.

According to yet another preferred embodiment of the present invention, a method is provided for creating a beverage cup holder assembly releasably mountable to a furniture member, the cup holder assembly including a base member, a lid and a biasing device. The method comprises: pressing the base member into frictional engagement with the furniture member; fastenably connecting the biasing device to the base member; slidingly engaging the lid with the base member until the lid contacts the biasing device; and forming a plurality of finger indentations in the lid operable to manually remove the lid from the base member.

A dampened retractable cup holder of the present invention provides several advantages. Because of its intended use as a holder of beverage containers for furniture applications, the use of removable elements promotes cleaning of the components if material is spilled into the cup holder. The use of removable elements also promotes maintenance or replacement of the damper assembly or cup components without damage to or removal of the furniture item. By using extensions radially extending from the cup holder lid and providing mating channels in the cup holder base, the lid is both retained against rotation within a cavity of the cup holder base during normal use and is removable for cleaning or maintenance. The use of finger grip indentations on the lid promotes manual removal of the lid. By releasably fastening a damper support member to the cup holder base, the damper assembly can be removed for maintenance or replacement.

Further areas of applicability of the present invention will become apparent from the detailed description provided hereinafter. It should be understood that the detailed description and specific examples, while indicating several preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a perspective view of a dampened retractable furniture cup holder according to a preferred embodiment of the present invention;

FIG. 2 is a plan view of the cup holder base and damper support member of the cup holder of FIG. 1;

FIG. 3 is a plan view of the cup holder of FIG. 1 showing the cup holder lid in its installed position;

FIG. 7 is a perspective view of a cup holder lid of the present invention;

FIG. 8 is a plan view of the cup holder lid shown in FIG. 7;

FIG. 9 is a side elevational view of the cup holder lid shown in FIG. 7;

FIG. 10 is a perspective view of a damper assembly according to one preferred embodiment of the present invention;

FIG. 11 is a front elevational view of the damper assembly shown in FIG. 10;

FIG. 12 is a bottom perspective view of a damper support member of the present invention;

FIG. 13 is a plan view of the damper support member shown in FIG. 12;

FIG. 14 is a side elevational view of the damper support member of FIG. 12;

DETAILED DESCRIPTION OF THE PREFERRED EMBODIMENTS

Figure 4:
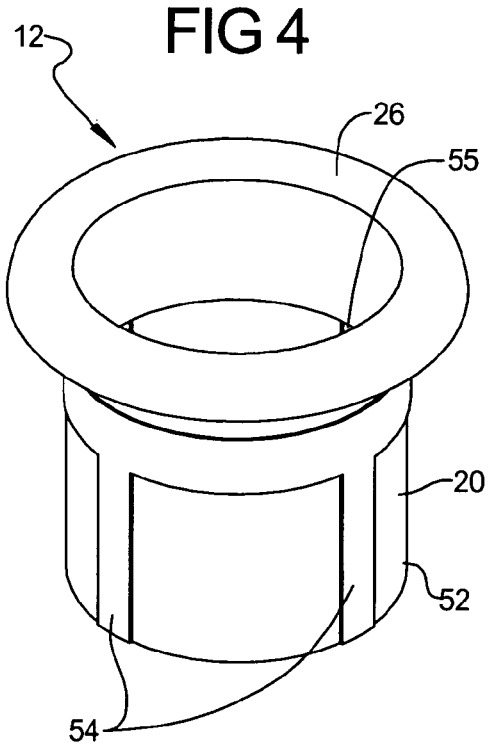
FIG. 4 is a perspective view of a cup holder base for the cup holder assembly of the present invention.

The following description of the preferred embodiments is merely exemplary in nature and is in no way intended to limit the invention, its application, or uses.

According to one preferred embodiment of the present invention and referring generally to FIG. 1, a dampened retractable furniture cup holder assembly 10 includes a cup holder base 12 which slidably supports a cup holder lid 14. A damper assembly 16 acting as a biasing device is disposed between cup holder base 12 and cup holder lid 14. In the embodiment shown, cup holder lid 14 has a substantially circular shape defining a lid outer perimeter "A". Cup holder base 12 provides a corresponding base inner cavity "B" which slidably receives the lid outer perimeter "A" of cup holder lid 14. Damper assembly 16 permits cup holder lid 14 to travel in each of the dampened travel paths identified by arrows "C". A damper support member 18 is fastenably connected to cup holder base 12 such that a cylinder diameter "D" of damper assembly 16 is received within a receiving aperture diameter "E" of damper support member 18.

Cup holder base 12 further includes a base body 20 which is received within a cavity 22 of a furniture member 24. In the example shown, furniture member 24 is an arm assembly for example of a reclining chair or a sofa. The invention is not limited to use in any specific type of furniture member 24 or to any component part of a furniture member. A base support member 26 formed as a flange radially extends outward from base body 20 and abuts with a member outer surface 28 of furniture member 24 in an installed position of cup holder base 12. Base body 20 is pressed into a receiving aperture (not shown) formed in member outer surface 28 such that base body 20 is frictionally engaged with furniture member 24 to resist withdrawal of base body 20. In one preferred embodiment of the present invention, cup holder base 12, cup holder lid 14 and damper support member 18 are each created from one or more polymeric materials to minimize weight and cost, while providing surfaces which can be cleaned, can be created in a multitude of colors and/or receive additional coatings such as faux wood or color laminates. The invention is not limited by the process used to mold or form cup holder base 12, cup holder lid 14 and/or damper support member 18.

Referring now in general to FIGS. 1 through 3, damper support member 18 includes a support flange 30 which is fastenably connected to a substantially flat support face 32 formed within base inner cavity "B". A common center point 34 of support face 32 locates a common center line for receiving aperture diameter "E" and a pair of fastener apertures 36 formed through support flange 30. A first and second fastener 38, 40 are each received in one of the fastener apertures 36 to fastenably engage damper support member 18 to cup holder base 12 such that a damper body cylinder 42 of damper assembly 16 is slidably received and frictionally retained within receiving aperture diameter "E" of damper support member 18.

Damper assembly 16 further includes a piston 44 which is slidably received within damper body cylinder 42. A piston head 46 forms a flattened surface which contacts a lid end surface 48 of cup holder lid 14. It is desirable that damper body cylinder 42 form a frictional fit within receiving aperture diameter "E" of damper support member 18 such that damper body cylinder 42 remains substantially stationary while piston 44 is capable of travel in either of the directions shown by damper travel path arrows "C". Damper assembly 16 can include a biasing device or can function as an air damper to provide a return force to redirect cup holder lid 14 from the depressed position to the fully extended position.

As shown in FIG. 1, at least one grip indentation 50 is provided in cup holder lid 14. In an alternate embodiment (not shown), an aperture through lid end surface 48 or an overlapped portion of lid end surface 48 is used in place of a single grip indentation 50. The purpose of grip indentation(s) 50 is to permit manual grasping of cup holder lid 14 for removal from cup holder base 12. Indentations in place of apertures are preferred for improved appearance as well as to reduce the chance of spilled liquid entering cup holder base 12. FIG. 3 shows another embodiment having two directly opposed grip indentations 50 created at a perimeter junction between lid end surface 48 and lid outer perimeter "A" of cup holder lid 14. By permitting manual removal of cup holder lid 14, any liquid or items spilled into cup holder base 12 can be cleaned and damper assembly 16 is accessible to be cleaned or replaced if necessary. Three or more grip indentations 50 can also be used.

According to one preferred embodiment of the present invention, cup holder assembly 10 is assembled by first pressing cup holder base 12 into cavity 22 of furniture member 24 until base support member 26 contacts member outer surface 28. Damper support member 18 is then connected to cup holder base 12 at support face 32 using first and second fasteners 38, 40 inserted into each of fastener apertures 36 of damper support member 18. Damper body cylinder 42 of damper assembly 16 is then slid into the receiving aperture of damper support member 18. Cup holder lid 14 is then placed in contact with piston head 46 of damper assembly 16 and pressed into base inner cavity "B" such that cup holder lid 14 can slide within base inner cavity "B" in either of the directions of damper travel path arrows "C". A fully extended position of cup holder lid 14 is provided when lid end surface 48 is approximately flush or even with base support member 26 of cup holder base 12. In the fully extended position, grip indentations 50 are accessible for manual removal of cup holder lid 14. Cup holder lid 14 can then be depressed downwardly as viewed in FIG. 1 which forces piston 44 of damper assembly 16 downward and into damper body cylinder 42. Piston 44 preferably provides some resistance to the depression of cup holder lid 14. If cup holder lid 14 is not latched or is released from a latched condition, as will be discussed further herein, piston 44 provides a return biasing force in an upward direction as viewed in FIG. 1 to return cup holder lid 14 to the fully extended position. As will be obvious to a skilled, practitioner, the order of assembly can be varied. For example, in one alternate procedure, damper support member 18 is connected to cup holder-base 12 before cup holder base 12 is pressed into cavity 22 of furniture member 24. In another alternate procedure, damper body cylinder 42 of damper assembly 16 is slid into the receiving aperture of damper support member 18 and cup holder lid 14 can be coupled to cup holder base 12 before cup holder base 12 is pressed into cavity 22 of furniture member 24.

Figure 5:
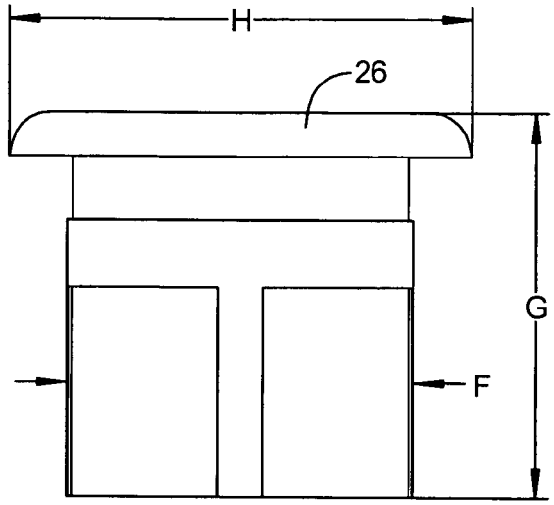
FIG. 5 is a side elevational view of the cup holder base shown in FIG. 4.
Figure 6:
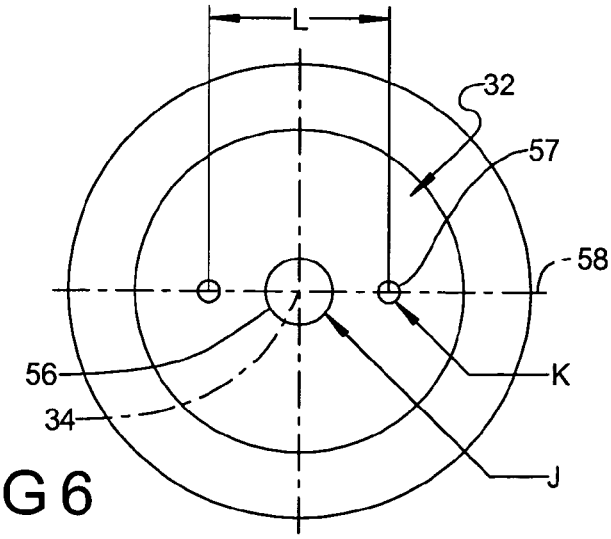
FIG. 6 is a plan view looking down at the cup holder base shown in FIG. 4.

As best seen in reference to FIGS. 4 through 6, cup holder base 12 further includes a body outer wall 52 substantially forming an outer perimeter of base body 20. At least one and preferably a plurality of raised surfaces 54 are provided radially extending outward from body outer wall 52. One purpose for raised surfaces 54 is to provide a friction fit when cup holder base 12 is pressed into cavity 22 of furniture member 24. In the embodiment shown, cup holder base 12 is substantially circularly shaped. An engagement outer diameter "F" is provided at the outermost extending surfaces of raised surfaces 54 which are arranged as at least one opposing pair of raised surfaces 54. It is desirable to provide opposing raised surfaces 54 to centrally align cup holder base 12 and prevent its relative rotation after installation. A total height "G" of cup holder base 12 is defined from an extreme end of base body 20 to a furthest extension of base support member 26. A support member diameter "H" is provided for base support member 26. Support member diameter "H" is larger than a receiving aperture (not shown) formed in member outer surface 28 of furniture member 24.

A cylinder clearance aperture 56 is created through support face 32 and is co-axially aligned with common center point 34. Cylinder clearance aperture 56 is larger than cylinder diameter "D" of damper body cylinder 42 of damper assembly 16. This permits damper body cylinder 42 to freely extend below support face 32 when damper assembly 16 is installed. Each of a pair of fastener apertures 57 as well as cylinder clearance aperture 56 are commonly aligned on an aperture locating axis 58. Cylinder clearance aperture 56 has an aperture diameter "J". Each of fastener apertures 57 have fastener aperture diameter "K". Fastener apertures 36 are each evenly spaced from common center point 34 and have a fastener aperture spacing "L". Fastener apertures 57 provide pilot holes for each of first and second fasteners 38, 40 if first and second fasteners 38, 40 are provided as threaded fasteners. Fastener apertures 57 are sized accordingly if first and second fasteners 38, 40 are provided as bolts or other types of removable fasteners instead of engaging threaded fasteners.

Referring now generally to FIGS. 7 through 9, cup holder lid 14 provides lid end surface 48 which is substantially perpendicularly positioned with respect to a lid outer perimeter wall 60. Each of the grip indentations 50 are formed at a junction between lid end surface 48 and lid outer perimeter wall 60. Lid outer perimeter wall 60 also provides at least one or more extensions 62 which are formed at angular increments 63 about lid outer perimeter wall 60. Each of the extensions 62 are preferably formed at an opposite end of cup holder lid 14 from lid end surface 48, however, the invention is not limited to this location for extensions 62. In one preferred embodiment of the present invention at least three extensions 62 are provided. In a further preferred embodiment of the present invention, four extensions 62 are provided each having an angular increment 63 from an adjacent one of extensions 62 of approximately 90°. One purpose for extensions 62 is to frictionally engage with base inner cavity "B" of cup holder base 12 which both centrally aligns cup holder lid 14 as well as maintaining a continuous sliding fit between the surfaces of extensions 62 and base inner cavity "B". Extensions 62 also prevent rotation of a circularly shaped cup holder lid 14 within a circular shaped cavity of cup holder base 12. Extensions 62 form a maximum engagement diameter "M". Each extension 62 extends radially outward from lid outer perimeter wall 60 having an extension height "N". A total lid height "P" is provided for cup holder lid 14. Lid height "P" is less than a total depth of base inner cavity "B".

Referring to both FIGS. 4 and 7, cup holder lid 14 can be rotated in base inner cavity "B" of cup holder base 12 until each extension 62 engages within one of a plurality of channels 55 formed in an interior facing wall of cup holder base 12. Each channel 55 corresponds to a location of one of the raised surfaces 54 extending radially outward from body outer wall 52. In each of the plurality of channels 55, extensions 62 are slidably located such that cup holder lid 14 can displace within cup holder base 12 while preventing rotation of cup holder lid 14 and also providing some resistance to removal of cup holder lid 14 from cup holder base 12. Grip indentations 50 and 88 provide for manual removal of the cup holder lids, overcoming the frictional resistance created by extensions 62.

Referring generally now to FIGS. 10 and 11, damper assembly 16 is shown in greater detail wherein piston 44 is slidably disposed within damper body cylinder 42. An exemplary embodiment of damper assembly 16 as an air damper is provided by U.S. Pat. No. 5,518,223, issued May 21, 1996 and assigned to Illinois Tool Works, Inc. Damper assembly 16 includes a maximum extension length "Q" which includes both damper body cylinder 42 and a fully extended length of piston 44 including piston head 46. A minimum retention length "R" is provided when piston 44 is depressed in the compression direction "T" and piston head 46 reaches a compressed hold location "S". Further compression of piston 44 in a release direction "U" from the compressed hold location "S" releases piston 44 from its latched position allowing the biasing elements of damper assembly 16 to return piston 44 to the maximum extension length "Q". The damper assembly 16 described is exemplary in nature and does not limit the scope of the invention. Other damper assemblies can be used including dampers that provide a plurality of extension heights if it is desired to accommodate different beverage cup heights.

As best seen in FIG. 10, damper assembly 16 also includes a latch device 64. Latch device 64 retains piston 44 and piston head 46 at the compressed hold location "S" shown in FIG. 11. To perform this function, latch device 64 engages with a latch engagement member 66 disposed on piston 44. In a preferred embodiment of the present invention, the engagement face 68 of piston head 46 directly abuts lid end surface 48 of cup holder lid 14. Optionally, a retaining adhesive 70 can be applied to engagement face 68 prior to engagement with lid end surface 48. If used, it is preferable that retaining adhesive 70 have a tacky quality which can maintain general contact between engagement face 68 and lid end surface 48 but still be removable to permit removal of cup holder lid 14 and disengagement of cup holder lid 14 and damper assembly 16.

Referring now generally to FIGS. 12 through 14, damper support member 18 includes an integrally provided tubular member 71 perpendicularly aligned with support flange 30. Tubular member 71 further includes a receiving aperture 72 having receiving aperture diameter "E" which slidably receives damper body cylinder 42 of damper assembly 16. Each of fastener apertures 36 formed in support flange 30 are also separated by fastener aperture spacing "L" so that fastener apertures 36 align with each of fastener apertures 57 formed in support face 32 of cup holder base 12. Damper support member 18 also includes a flange total width "V", a flange length "W", an aperture spacing dimension "X", a shaft support height "Y" and a flange thickness "Z".

In one preferred embodiment of the present invention, dimensions for the various components are as follows: Lid outer perimeter "A" is 91.44 mm (3.6 in), cylinder diameter "D" is 17.5 mm (0.69 in), receiving aperture diameter "E" is 17.65 mm (0.695 in), height "G" is 110.23 mm (4.34 in), support member diameter "H" is 131.32 mm (5.17 in), aperture diameter "J" is 19.05 mm (0.75 in), fastener aperture diameter "K" is 6.35 mm (0.25 in), fastener aperture spacing "L" is 50.8 mm (2.0 in), lid height "P" is 53.97 mm (2.125 in), maximum extension length "Q" is 14.89 centimeters (5.86 in), flange total width "V" is 50.8 mm (2.0 in), flange length "W" is 63.5 mm (2.50 in), aperture spacing dimension "X" is 25.4 mm (1.0 in), shaft support height "Y" is 35.2 mm (1.386 in), and flange thickness "Z" is 6.35 mm (0.25 in). These dimensions are exemplary of one embodiment of the present invention. These dimensions can be varied at the designers discretion and do not limit the invention.

Figure 15:
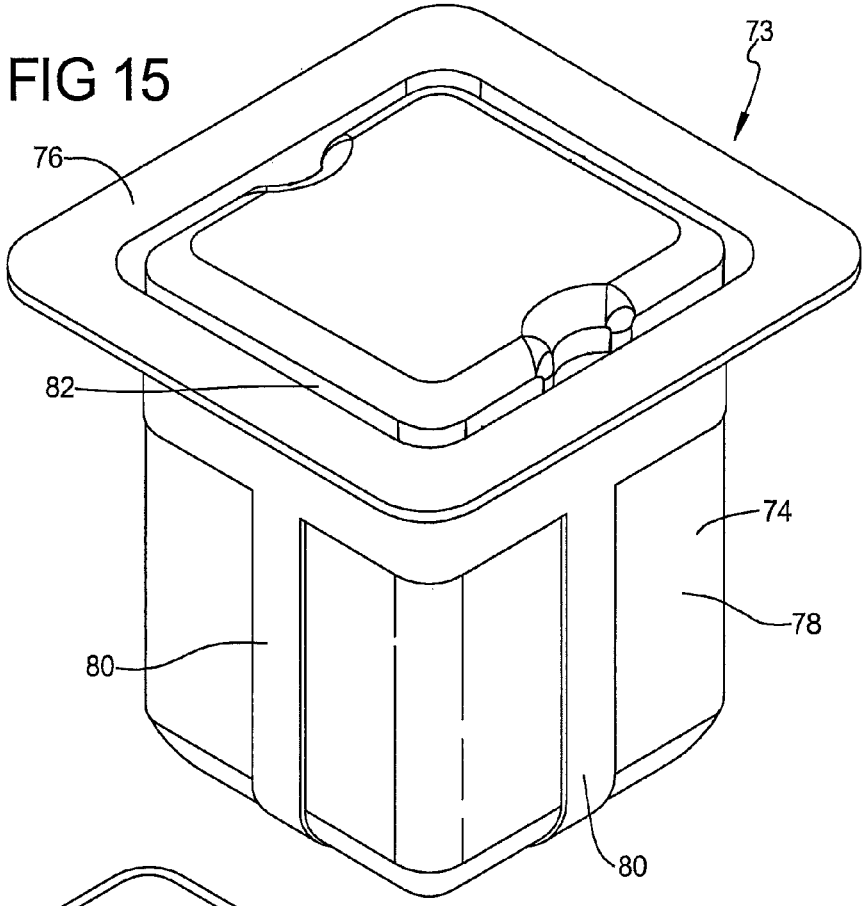
FIG. 15 is a perspective view of a rectangular shaped cup holder base and cup holder lid assembly according to another preferred embodiment of the present invention.
Figure 16:
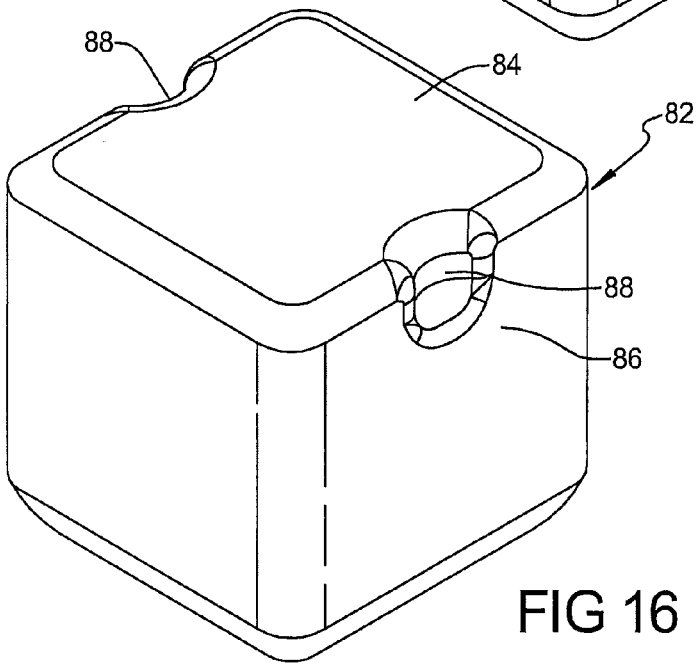
FIG. 16 is a perspective view of a rectangularly shaped cup holder lid according to another preferred embodiment of the present invention.

Referring generally now to both FIGS. 15 and 16, in another preferred embodiment of the present invention, a generally rectangular shaped cup holder base 73 is used instead of the generally circular shaped cup holder base 12. Cup holder base 73 includes a generally rectangular shaped base body 74, a rectangular shaped base support member 76 similar to base support member 26, a rectangular shaped body outer wall 78 optionally having a plurality of raised surfaces 80. A generally rectangular shaped cup holder lid 82 is provided to slidably mate within a cavity of cup holder base 73. Cup holder lid 82 includes a lid end surface 84, a lid outer perimeter wall 86 formed in a generally rectangular shape, a plurality of grip indentations 88 (similar to grip indentations 50). Extensions 62 (not shown) are not necessary to prevent rotation of cup holder lid 82, but can optionally be provided on cup holder lid 82 to provide additional resistance to removal of cup holder lid 82 along with one or more mating channels similar to channels 55 provided by raised surfaces 80. The invention is not limited to the circular or rectangular shapes of the cup holder lid and cup holder base identified herein. Alternate geometric shapes can also be used, including, but not limited to triangular, square, oval, etc.

Furniture member 24 commonly includes an upholstery or fabric covering 25 (See FIG. 1) disposed over a framework, typically including an arm or section for installation of the cup holder assembly of the present invention. The furniture cup holder assembly of the present invention is removable from an installed condition in furniture member 24 without disturbing or removal of the fabric or upholstery of furniture member 24. This removable feature facilitates ease of field service and also facilitates manufacturing assembly and frame upholstery because the cup holder assembly is positionable through an aperture in the upholstery covering 25 after installation of the upholstery. Any of the component parts of the cup holder assembly are removable from cup holder base 12 without removing the cup holder base 12 from furniture member 24. This facilitates cleaning and replacement of the component parts without requiring total assembly replacement, removal of the furniture member or upholstery damage.

A dampened retractable cup holder of the present invention provides several advantages. Because of its intended use as a holder of beverage containers for furniture applications, the use of removable elements promotes cleaning of the components if material is spilled into the cup holder. The use of removable elements also promotes maintenance or replacement of the damper assembly or cup components without damage to, removal of or replacement of the furniture item. By using radial extensions of the cup holder lid and providing mating channels in the cup holder base, the lid is both retained against rotation within a cavity of the cup holder base during normal use and is removable for cleaning or maintenance. The use of finger grip indentations on the lid promotes manual removal of the lid. By releasably fastening a damper support member to the cup holder base, the damper assembly can be removed for maintenance or replacement.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A furniture mounted cup holder, comprising:

a cup holder base retainable by a furniture member;

a lid slideably received within the cup holder base, the lid including a plurality of finger grip indentations operable to manually grasp the lid for removal from the cup holder base; and a dampening device positioned between the cup holder base and the lid operable to temporarily retain the lid in a depressed position and to return the lid to a fully extended position.

2. The cup holder of claim 1, wherein the dampening device further comprises:

a displaceable piston; and a latch device operable to releasably latch the piston with the lid in the depressed position.

3. The cup holder of claim 2, wherein the displaceable piston further comprises a flattened distal end.

4. The cup holder of claim 3, wherein the lid further comprises a flattened end surface operably abutting the flattened distal end of the piston in both the lid depressed and fully extended positions.

5. The cup holder of claim 1, further comprising a damper support member connectable to the cup holder base, the damper support member operable to slidably receive the dampening device.

6. The cup holder of claim 5, further comprising at least one fastener operable to releasably fasten the damper support member to the cup holder base.

7. The cup holder of claim 1, wherein the lid further comprises;

an outer perimeter wall; and a plurality of extensions extending radially outward from the outer perimeter wall;

wherein each extension slidingly engages with an inner perimeter wall of the cup holder base.

8. A furniture mounted cup holder, comprising:

a cup holder base retainable by a furniture member, the cup holder base including at least one raised surface member extending radially outward and operable to resist rotation of the cup holder base when retained by the furniture member; and a lid slideably received within the cup holder base, the lid including:

an outer perimeter wall;

a plurality of extensions extending radially outward from the outer perimeter wall of the cup holder base; and a plurality of finger grip indentations operable to manually grasp the lid for removal from the cup holder base;

wherein each extension slidingly engages with an inner perimeter wall of the cup holder base.

9. The cup holder of claim 8, wherein each raised surface member operably creates a channel at the inner perimeter wall of the cup holder base operable to slidably receive one of the extensions and prevent rotation of the lid with respect to the cup holder base.

10. A furniture mounted cup holder, comprising:

a cup holder base retainable by a furniture member, the cup holder base including at least one raised surface member extending radially outward and operable to resist rotation of the cup holder base when retained by the furniture member; and a lid slideably received within the cup holder base, the lid including:

an outer perimeter wall; and a plurality of extensions extending radially outward from the outer perimeter wall;

wherein each raised surface member operably creates a channel at an inner perimeter wall of the cup holder base operable to slidably receive one of the extensions and prevent rotation of the lid with respect to the cup holder base.

11. The cup holder of claim 10, wherein the lid further comprises a plurality of finger grip indentations operable to manually grasp the lid for removal from the cup holder base.

12. The cup holder of claim 10, further comprising a biasing device positioned between the cup holder base and the lid operable to temporarily retain the lid in a depressed position and to return the lid to a fully extended position.

13. The cup holder of claim 10, wherein each of the cup holder base and the cup holder lid comprise one of a plurality of polymeric materials.

14. A furniture mounted cup holder device, comprising:

a cup holder base having a perimeter wall defining an interior cavity;

a lid slidably received within the cavity, the lid including:

a substantially flat end surface adapted to support a beverage container;

an outer perimeter wall slidingly positionable adjacent the cup holder base perimeter wail; and at least two finger grip indentations created at a junction between the outer perimeter wall and the end surface; and a biasing device having a first end continuously contacting the end surface of the lid, the biasing device being operable to displace the lid between a lid depressed position and a lid extended position.

15. The device of claim 14, wherein the biasing device comprises a latch mechanism operable to latch the lid in the lid depressed position.

16. The device of claim 14, wherein the perimeter wall of the cup holder base comprises a substantially cylindrical shape.

17. The device of claim 14, wherein the perimeter wall of the cup holder base comprises a substantially rectangular shape.

18. The device of claim 14, wherein the cup holder base further comprises:

a plurality of raised surfaces radially extending from the perimeter wall; and a perimeter flange radially extending from the perimeter wall at one end of the cup holder base, the perimeter flange operable to abut a furniture member.

19. The device of claim 14, further comprising a support member fastenably connectable to the cup holder base and operable to support the biasing device.

20. The device of claim 19, wherein the support member further comprises:

a flange having at least one fastener clearance aperture; and a tubular body perpendicularly joined to the flange, the tubular body having a receiving aperture slidably receiving the biasing device.

21. The device of claim 14, wherein the lid further comprises:

a plurality of extensions extending radially outward from the outer perimeter wall;

wherein each extension slidingly engages with the perimeter wall within the interior cavity of the cup holder base.

22. The device of claim 21, wherein the cup holder base further comprises at least one raised surface member extending radially outward and operable to resist rotation of the cup holder base when retained by a furniture member.

23. The device of claim 22, wherein each raised surface member operably creates a channel at an inner perimeter wall of the cup holder base operable to slidably receive one of the extensions and prevent rotation of the lid with respect to the cup holder base.

24. A cup holder system, comprising:

a furniture member;

a cup holder base having an open ended cavity, the base releasably mounted to the furniture member;

a lid slidably positionable within the cup holder base;

a plurality of finger grip indentations formable in the lid and operable to manually remove the lid from the cup holder base; and a dampening device mounted to the cup holder base and contacting the lid;

wherein the dampening device is operable to displace the lid at least between a depressed position and a fully extended position.

25. The system of claim 24, further comprising a support member mechanically joined to the cup holder base and operable to support the dampening device.

26. The system of claim 25, further comprising a plurality of fasteners operable to releasably connect the support member to the holder base.

27. The system of claim 24, wherein the lid further comprises:

a generally tubular body portion having first and second ends;

an end section perpendicularly aligned to the tubular body and positioned at the tubular body first end; and a plurality of raised extensions positioned at the tubular body second end.

28. The system of claim 27, wherein each one of the plurality of raised extensions is equally circumferentially spaced about the second end of the tubular body and extends radially outward from the tubular body.

29. The system of claim 28, wherein the plurality of raised extensions comprises at least three extensions each spaced at substantially equivalent angular intervals from an adjacent one of the raised extensions.

30. The system of claim 29, wherein the plurality of raised extensions comprises four extensions and each of the angular intervals is approximately 90 degrees.

31. The system of claim 26, further comprising an adhesive disposed between the dampening device and the lid, the adhesive being releasable to permit removal of any of the lid, the dampening device, the support member and the fasteners from the cup holder base without removal of the cup holder base from the furniture member.

32. The system of claim 24, further comprising an upholstery covering disposed on the furniture member, the cup holder base being mounted to the furniture member through an aperture in the upholstery covering, wherein the cup holder base is removable from the furniture member without removal of the upholstery covering.

33. A method for creating a beverage cup holder assembly releasably mountable to a furniture member, the cup holder assembly including a base member, a lid and a biasing device, the method comprising:

pressing the base member into frictional engagement with the furniture member;

fastenably connecting the biasing device to the base member;

slidingly engaging the lid with the base member until the lid contacts the biasing device; and forming a plurality of finger indentations in the lid operable to manually remove the lid from the base member.

34. The method of claim 33, further comprising depressing the lid against a biasing force of the biasing device.

35. The method of claim 34, further comprising latching the lid at a depressed position using the biasing device.

36. The method of claim 35, further comprising:

further depressing the lid past the depressed position to unlatch the lid; and returning the lid to a fully extended position using the biasing device.

37. The method of claim 35, further comprising selecting a dampening device as the biasing device.

38. The method of claim 37, further comprising automatically engaging a latching device of the dampening device during the latching step.

39. The method of claim 33, further comprising centering the lid in a cavity of the base member using a plurality of extension elements radially extending from the lid.

40. The method of claim 39, further comprising spacing each of the extension elements equidistantly about the lid.

41. The method of claim 33, further comprising oppositely positioning each of a pair of the finger indentations from each other.

* * * * *